United States Patent [19]

Ross

[11] 3,946,562

[45] Mar. 30, 1976

[54] HYDRAULIC SYSTEM CAVITATION SUPPRESSOR

[75] Inventor: Louis Ross, Des Plaines, Ill.

[73] Assignee: Borg-Warner Corporation, Chicago, Ill.

[22] Filed: Nov. 7, 1974

[21] Appl. No.: 521,820

[52] U.S. Cl. ..... 60/464; 60/468; 60/494; 137/115

[51] Int. Cl.[2] ..... F15B 21/04

[58] Field of Search ..... 60/329, 378, 464, 468, 60/494; 417/175, 186, 307, 309; 137/115, 116

[56] References Cited

UNITED STATES PATENTS

| | | | |
|---|---|---|---|
| 265,246 | 10/1882 | Conord | 417/198 |
| 2,251,664 | 8/1941 | Davis | 60/494 |
| 2,325,931 | 8/1943 | Avigdor | 137/339 X |
| 2,367,055 | 1/1945 | Rike et al. | 158/36.3 |
| 2,625,797 | 1/1953 | Poort et al. | 60/481 X |
| 2,746,250 | 5/1956 | Hawkins | 137/115 X |
| 2,802,337 | 8/1957 | Bunch | 60/468 X |
| 3,043,107 | 7/1962 | Magnus | 60/494 X |
| 3,111,091 | 11/1963 | Hopkinson | 417/186 |
| 3,166,020 | 1/1965 | Cook | 417/198 |
| 3,370,423 | 2/1968 | Vaughan | 60/464 X |
| 3,664,768 | 5/1972 | Mays et al. | 417/197 |

*Primary Examiner*—Edgar W. Geoghegan
*Attorney, Agent, or Firm*—Julian Schachner

[57] ABSTRACT

A cavitation suppressor for use in a hydraulic system, the cavitation suppressor serving to prevent excessive pressure in the system by bypassing hydraulic fluid around a mixing section to reduce the need for aspiration of additional fluid from a reservoir. The cavitation suppressor also prevents dissolved air in the system from coming out of solution. It includes inlet, mixing and outlet sections, and fluid bypass means communicating the inlet section with the outlet section.

12 Claims, 2 Drawing Figures

HYDRAULIC SYSTEM CAVITATION SUPPRESSOR

BACKGROUND OF THE INVENTION

1. Field of the Invention

This invention relates generally to the suppression of cavitation in a hydraulic system, and more particularly to a cavitation suppressor in a hydraulic system which provides for bypass of fluid from the inlet to the outlet thereof so as to control fluid pressure and control air dissolved in the fluid.

2. Description of the Prior Art

In recent years there have been many improvements in hydraulic system control, including improvements relating to the suppression of cavitation and the control of system pressures. Some of these improvements provide for diverting the direction of the main stream of fluid flow through a jet pump in an attempt to smooth out flow and pressure within the system. Others provide for changes in the pattern of flow from a source of fluid to a venturi to create suctions which tend to provide desired flow patterns at an outlet.

Prior art systems generally have provided for the drawing of fluid from a reservoir as needed to maintain proper flow rates and pressures within the system. Attempts to maintain reduced pressures, where higher pressures are unnecessary, generally have resulted in loss of efficiency throughout the system. Furthermore, the prior art has not recognized the problem of air dissolved in the fluid, and the attendant problem introduced when oil from a tank is drawn into the hydraulic system.

Accordingly, it is an object of this invention to meet the continuing need and desire in the art for improvements in the control of hydraulic systems, and in particular the suppression of cavitation therein, by providing an improved hydraulic system including means for suppressing cavitation and for preventing unnecessary high pressure when system flow is high.

SUMMARY OF THE INVENTION

This invention is directed in brief to improved fluid control means adapted for use in a hydraulic system wherein variable loads are encountered and wherein the control of pressure and of air dissolved in a hydraulic fluid is desired.

The system includes means for guiding the flow of fluid in such a fashion that efficient conversion of pressure energy to velocity and then back to pressure energy is obtained. The high velocity section is vented to the reservoir, thereby establishing an atmospheric pressure reference at this point. All other points in the hydraulic system will then be at pressures higher than atmospheric, thus preventing the evolution of dissolved air.

The inlet to the hydraulic system control means is the return line of an associated hydraulic circuit. At this point the pressure is appreciable. As oil enters the device, it passes through a nozzle or orifice which increases the oil velocity and reduces the static pressure. It then passes through a venturi or high velocity section where it is exposed to the approximate atmospheric pressure of the reservoir. It then passes through the final tapered outlet section where it loses velocity and regains most of its previous static pressure. To avoid over pressurizing the oil, a fluid bypass passage diverts some of the flow from the inlet of the device to the discharge when inlet pressure increases to a predetermined level.

The system includes a cavitation suppressor having an input section, an intermediate mixing section and an output section. In addition, a fluid passage from the input section to the output section is provided to divert fluid around the mixing section without dumping it to tank, thereby retaining it within the system and reducing the need for aspiration of fluid from the tank through the mixing section. Furthermore, valve means is provided in the passage to establish the pressure at which diversion takes place.

BRIEF DESCRIPTION OF THE DRAWING

The objects and advantages of this invention will become apparent to those skilled in the art upon careful consideration of the specification herein, including the drawing, wherein.

Figure 1:
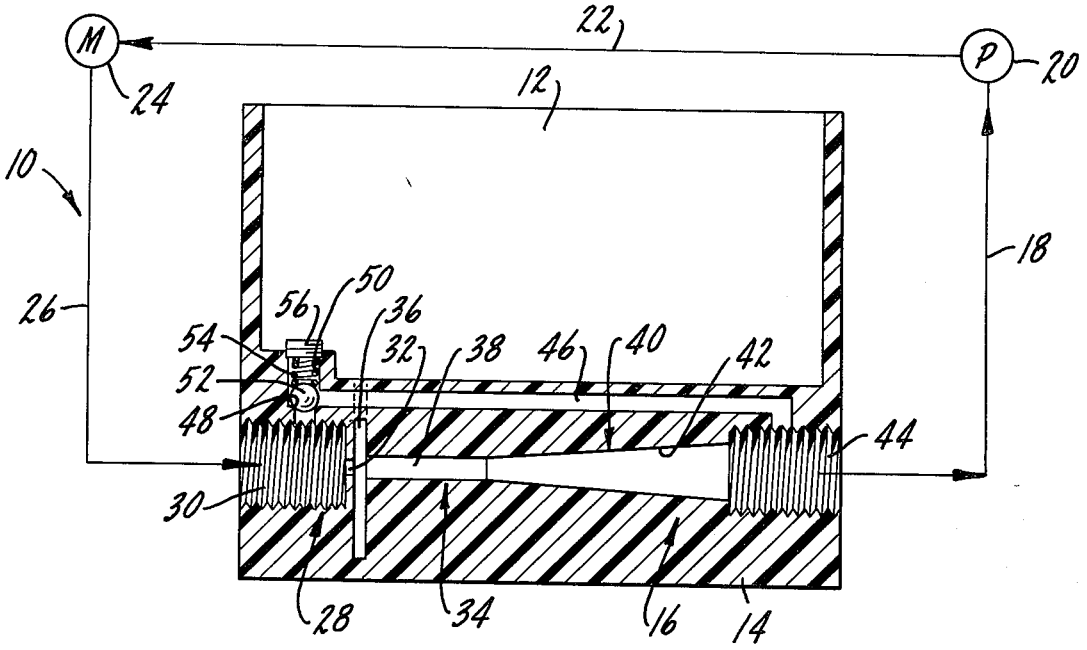
FIG. 1 is a cross-sectional view showing the relationship of the improved cavitation suppressor to an associated hydraulic system.

While this invention is susceptible of embodiment in many different forms, there is shown in the drawing and will herein be described in detail a preferred embodiment and an alternative embodiment, with the understanding that the present disclosure is to be considered as an exemplification of the principles of the invention and is not intended to limit the invention to these embodiments.

DESCRIPTION OF THE PREFERRED EMBODIMENT

Referring now to the drawing in greater detail, there is shown a hydraulic system 10 including a fluid reservoir or tank 12. Reservoir 12 may be formed of plastic material and has a base 14 in which is molded a cavitation suppressor generally designated 16.

A fluid line 18 communicates cavitation suppressor 16 with a pump 20 which may be fixed or variable displacement. A fluid line 22 communicates pump 20 with a fluid motor 24 which may be a double acting cylinder, a rotary motor or the like, and which constitutes a variable load. A fluid line 26 communicates motor 24 with cavitation suppressor 16.

Cavitation suppressor 16 includes inlet or orifice section 28 having a threaded inlet 30 adapted to receive fluid line 26. Inlet section 28 is provided with an orifice 32 for accelerating the flow of fluid to a relatively high velocity as it passes therethrough.

Cavitation suppressor 16 includes a mixing section 34 spaced from inlet section 28 to define therebetween a fluid flow path 36 communicating with reservoir 12. Mixing section 34 defines a fluid passage 38 opposite orifice 32. Passage 38 is relatively larger than orifice 32.

Cavitation suppressor 16 also includes an outlet or pressure recovery section 40 defining a fluid passage 42 communicating with passage 38 and tapered to diverge away therefrom. Passage 42 communicates with threaded outlet 44 adapted to receive fluid line 18.

A fluid bypass passage 46 extends from inlet 30 to outlet 44 for providing a direct fluid flow path therebetween. In passage 46 there is formed a valve seat 48. A chamber 50 communicates with passage 46 opposite valve seat 48. A suitable ball valve 52 in chamber 50 is seated on valve seat 48. A valve spring 54 reacts against a cap 56 in chamber 50 and biases ball valve 52 against valve seat 48, thereby blocking passage 46 when ball valve 52 is seated on valve seat 48.

Flow path 36, in communication with reservoir 12 establishes approximately atmospheric pressure just beyond orifice 32. With this as a reference, all other points in the hydraulic system will be at pressures higher than atmospheric.

Fluid is discharged from motor 24 and flows through line 26 into inlet section 28. As fluid passes through orifice 32 its velocity is increased and its static pressure is decreased. Fluid then passes through mixing section 34 where it is exposed to the approximate atmospheric pressure in reservoir 12, after which it passes through outlet section 40 where it loses velocity and regains most of its static pressure. It then flows through line 18 to pump 20.

To prevent excessive pressure at pump 20, even when fluid flow is high, for example when pump RPM is high, some of the fluid is diverted through passage 46. This will occur when pressure reaches a predetermined level sufficient to move ball valve 52 away from valve seat 48, thereby establishing fluid communication from inlet 30 through passage 46 to outlet 44. As pressure increases, ball valve 52 will be moved farther away from valve seat 48. The result is that as more fluid is bypassed through passage 46, there will be less flow through mixing section 34, and accordingly less fluid aspirated from reservoir 12 through path 36 into passage 38. By this means, pressure in the system will remain relatively close to the pressure at which the bypass function is initiated.

Thus the pressure at outlet 44 is limited even in a system with widely varying load characteristics. By controlling the fluid flow through orifice 32, the aspiration of additional fluid from reservoir 12 through passage 36 into the system is limited, and indeed is significantly reduced.

By reducing the necessity for discharing excess fluid to reservoir 12 when system pressures are undesirably high, and then drawing fluid from reservoir 12 when again required, the stability of the system is improved. A significant reduction of cavitation results and this in turn results in improved efficiency of the system, particularly when using high viscosity oils. Air in the system will remain dissolved in the fluid. This is a significant factor, as it has been found that some air is dissolved in hydraulic fluid even in an open tank. Indeed, it has been found that at standard temperatures and pressures, as much as 8 percent air is in solution.

As pump pressure increases, the efficiency of the system is improved by using the suppressor with the bypass feature. This is particularly apparent at lower temperatures, with increased oil viscosities.

DESCRIPTION OF AN ALTERNATIVE EMBODIMENT

Figure 2:
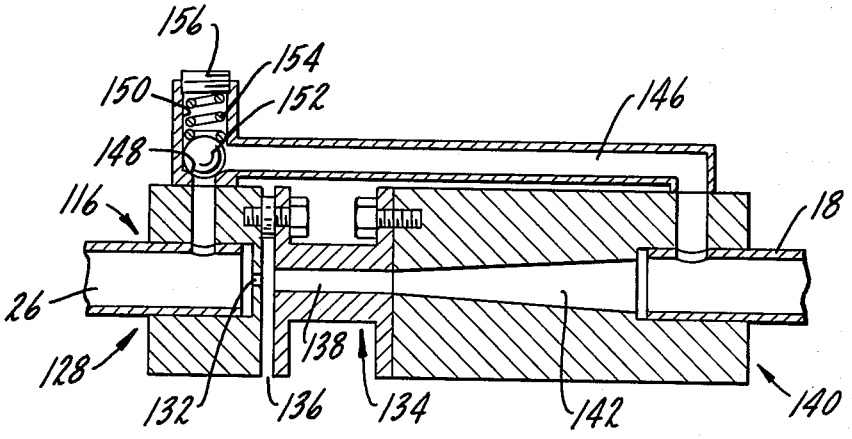
FIG. 2 is a cross-sectional view showing details of a modified form of the cavitation suppressor.

Turning now to FIG. 2, there is shown a cavitation suppressor 116 which is essentially similar to cavitation suppressor 16 of FIG. 1, except that it is formed from metal or other suitable material rather than being molded into base 14 of reservoir 12.

Cavitation suppressor 116 includes an inlet section 128 which receives fluid line 26 and which defines a suitable orifice or nozzle 132.

A mixing section 134 is secured to inlet section 128 by suitable bolts and spacers or the like to establish a fluid path 136. Mixing section 134 defines a fluid passage 138 opposite orifice 132.

An outlet section 140 is suitably secured to mixing section 134 by bolts or the like and receives fluid line 18. A pressure reducing passage 142 diverges outwardly from passage 138 and communicates with fluid line 18.

Bypass passage 146 communicates inlet section 128 with outlet section 140 to divert fluid around mixing section 134 without discharging it to reservoir. A suitable valve seat 148 is provided in line 146. A chamber 150 is opposite valve seat 148 and contains a ball valve 152 seated on valve seat 148. A suitable spring 154 reacts against a cap 156 and biases ball valve 152 against valve seat 148.

Cavitation suppressor 116 operates in a manner essentially similar to cavitation suppressor 16. Suppressor 116, however, is located within a reservoir such that path 136 is in fluid communication with a source of fluid. Alternatively, a suitable fluid line communicates path 136 with a source of fluid.

The invention disclosed herein will work with a wide variety of hydraulic fluids, and provides significantly improved overall efficiency, even at low temperatures.

The improved system will keep pump inlet pressure high enough to maintain any air in the inlet oil dissolved therein, so as to reduce cavitation. At the same time, the system prevents excessive pressure at the pump inlet.

The system disclosed herein provides freedom of design which will allow for the provision of smaller orifices than might otherwise be required. This will increase the efficiency and effectiveness of the system at low flow rates, such as for example, with the pump running at a low RPM.

Although a preferred embodiment and an alternative embodiment of the invention have been shown and described, they should be considered as illustrative and may be modified by those skilled in the art without departing from the scope thereof, which is to be limited only by the claims herein.

I claim:

1. A fluid control device comprising an inlet section defining an orifice, an outlet section defining an expansion chamber, a mixing section intermediate said inlet and outlet sections into which fluid may be drawn by fluid flow through said orifice, and fluid bypass means communicating said inlet and outlet sections.

2. The invention of claim 1, said fluid bypass means including pressure responsive means for increasing said communication as pressure in said inlet section increases above a predetermined level.

3. The invention of claim 2, said inlet and mixing sections defining therebetween a fluid path through which fluid may be drawn into said mixing section.

4. A fluid control device comprising an inlet section having a fluid inlet and a fluid velocity increasing outlet, an outlet section having a fluid velocity-decreasing inlet and a fluid outlet, a mixing section in fluid communication with said fluid velocity-increasing outlet and said fluid velocity-decreasing inlet, fluid passage means communicating with said mixing section, and bypass passage means communicating said fluid inlet with said fluid outlet.

5. The invention of claim 4, including pressure responsive valve means in said bypass passage means for blocking communication therethrough in response to pressure at said fluid inlet below a predetermined level.

6. In a hydraulic system including a source of fluid, a pump having an inlet and an outlet, a motor having an inlet in fluid communication with said pump outlet and an outlet, and fluid flow control means including a velocity-increasing section in fluid communication with said motor outlet, a high velocity section in fluid communication with said source of fluid, and a velocity-reducing section in fluid communication with said pump inlet, said sections acommodating fluid flow therethrough from said motor to said pump; the improvement comprising fluid bypass means communicating said velocity-increasing section with said velocity-decreasing section for bypass of fluid around said high velocity section.

7. The invention of claim 6, said fluid bypass means including means responsive to pressure in said velocity-increasing section for preventing said fluid bypass below a predetermined pressure.

8. The invention of claim 7, said pressure responsive means affording said fluid bypass above said predetermined pressure.

9. The invention of claim 8, said source of fluid being a reservoir.

10. The invention of claim 9, said reservoir and said fluid flow control means being integrally molded of plastic.

11. A hydraulic system including a reservoir; a pump; a motor in fluid communication with said pump; and cavitation suppressing means having a pressure-reducing section influid communication with said motor, a mixing section in fluid in fluid with said reservoir, a pressure-increasing section in fluid communication with said pump, and fluid bypass means in fluid communication with said pressure-reducing and pressure-increasing sections.

12. The invention of claim 11, said fluid bypass means including means for regulating fluid bypass therethrough in response to pressure between said motor and said pressure-reducing section above a predetermined level.

* * * * *